US010607767B2

(12) United States Patent
Fan

(10) Patent No.: US 10,607,767 B2
(45) Date of Patent: Mar. 31, 2020

(54) BURIED INDUCTIVE ELEMENT STRUCTURE OF SLIM TYPE

(71) Applicant: Yun-Kuang Fan, Taoyuan (TW)

(72) Inventor: Yun-Kuang Fan, Taoyuan (TW)

( * ) Notice: Subject to any disclaimer, the term of this patent is extended or adjusted under 35 U.S.C. 154(b) by 437 days.

(21) Appl. No.: 15/702,769

(22) Filed: Sep. 13, 2017

(65) Prior Publication Data

US 2018/0005750 A1 Jan. 4, 2018

Related U.S. Application Data

(63) Continuation-in-part of application No. 14/742,125, filed on Jun. 17, 2015, now abandoned.

(51) Int. Cl.

| | |
|---|---|
| ***H01F 27/40*** | (2006.01) |
| ***H01F 27/29*** | (2006.01) |
| ***H01F 27/26*** | (2006.01) |
| ***H01F 27/28*** | (2006.01) |
| *H01F 17/06* | (2006.01) |
| *H01F 17/04* | (2006.01) |

(52) U.S. Cl.

CPC ..... *H01F 27/29* (2013.01); *H01F 27/266* (2013.01); *H01F 27/2828* (2013.01); *H01F 27/292* (2013.01); *H01F 27/40* (2013.01); *H01F 17/045* (2013.01); *H01F 17/062* (2013.01)

(58) Field of Classification Search

USPC ..... 361/270

See application file for complete search history.

(56) References Cited

U.S. PATENT DOCUMENTS

2011/0025441 A1* 2/2011 Tien ..... H01F 17/062 336/65

2013/0194061 A1* 8/2013 Wei ..... H01F 17/043 336/192

* cited by examiner

*Primary Examiner* — Danny Nguyen

(74) *Attorney, Agent, or Firm* — Lin & Associates Intellectual Property, Inc.

(57) ABSTRACT

A buried inductive element structure includes a base having a chamber, two stands and two terminals, wherein the chamber having a holding space is formed on the base, each stand is arranged on a corner of the base, the two terminals are respectively mounted inside the two stands, a bending part is formed on a top of each of the two terminals and is exposed to the base and each stand, a hook part is formed on the bottom of each of the two terminals, a part of the hook part is arranged inside the base, another part of the hook part is exposed to the base and is defined as a connecting part. The coil has two ends connected electrically and respectively to the bending part of the terminals. The electronic component is connected electrically to the connecting parts of the two terminals.

10 Claims, 13 Drawing Sheets

BURIED INDUCTIVE ELEMENT STRUCTURE OF SLIM TYPE

CROSS-REFERENCE TO RELATED APPLICATION

This application is a continuation-in-part of U.S. patent application Ser. No. 14/742,125, filed on Jun. 17, 2015, which is incorporated herewith by reference.

BACKGROUND OF THE INVENTION

1. Field of the Invention

The present invention relates to an element connecting structure, more particularly to a buried inductive element structure of slim type including a base in which at least two electronic components are buried so as to facilitate designing compact basic circuits within an electronic device, thereby increasing the layout of circuit density and electronic elements in an electronic device.

2. The Prior Arts

Sizes shrink is the major trench in the integrated circuit fabrication field in order to produce compact electronic devices so that plug-in type electronic components implemented within the electronic devices are gradually replaced by SMD (Surface Mount Devices).

FIG. 1 shows a conventional surface mount device, such as an inductive element, which is generally I-shaped including a central core 1 constituted by an upper flange 11, an intermediate part 14 and a lower flange 12. The upper and lower flanges 11, 12 are formed with a pair of notches 111, 111', 121, 121' respectively while a pair of recesses 13 are formed on an upper surface of the upper flange 11 proximate to the notches 111, 111' respectively. Moreover, a silver layer (not visible) is coated over the upper surface of the upper flange 11 such that after winding turns of a wire coil 2 are wrapped around the intermediate part 14, the opposite ends 21, 22 of the wire coil 2 passed through the notches 111, 111' are bent into the recesses 13 respectively and are soldered to the silver layer through soldering process, thereby securing the ends 21, 22 of the wire coil 2 within the recesses 13 and connected to the silver layer on the upper surface 11 of the central core 1.

The above SMD has a relatively small height or thickness when compared to a plug-in element, but handheld mobile devices are in the trend of sizes shrink such that said SMD is not suitable to be implemented in a handheld mobile device owing to its configuration as best shown in FIG. 1, since the total thickness of the inductive element cannot be restricted below 2 mm.

Moreover, in FIG. 1, it is required to apply manually a solder paste in order to form the silver layer and the opposite ends 21, 22 of the wire coil 2 still require manual labor to be bent into the recess 13 only then can be fixed on the silver layer through tin soldering process 16. The inductive element produced as stated above then can be applied in a printed circuit board and can establish electrical connection with the circuits of the circuit board.

For a wound-type inductive element, winding turns of the wire coil are required to be wrapped around a central core such that the wound-type inductive element does not provide vacuum suction means or planar surface for gripping operations. Hence, mounting of the inductive element relative to a printed circuit board is conducted via manual soldering process. No automatic machines or devices can be used when mounting such type of inductive element in the circuit board, which in turn, hinders high mass production of low cost printed circuits. Manual soldering process causes non-precision and tolerance error among the electronic components.

Since winding turns of the wire coil 2 are wrapped only around the intermediate part 14 of the central core 1 (leaving the other un-wrapped parts), the inductance capacity thereof cannot be increased owing to restriction in the number of winding turns of the wire coil 2. In addition, since the currently available inductive elements are complicated in structures, the manufacturing cost the same is hard to be reduced.

The applicant has in Taiwan Patent Published No. M490096 proposed an inductive element of slim type with the intention and design of reducing the total thickness, in which, the wire coil is disposed in a reception chamber of the base, thereby achieving in reduced thickness and increasing the inductance capacity. However, the inductive element in the circuit path must integrate with other electronic elements for performing filtering, oscillating, phase shifting or resonant modulating etc, as multiple circuits.

Unlike to the prior art single integrated element, where only an inductive element is disposed in the base while the other electronic components occupy the receiving space in the circuit board, it is highly desired to develop an active or passive type inductive element structure of slim size including a base constituted by at least two electronic components so as to enhance the circuit layout within an electronic device, thereby enabling the electronic device to posses finer circuit density, reducing the occupied space but providing higher function features.

SUMMARY OF THE INVENTION

Therefore, the objective of the present invention is to provide an element connecting structure, which is simple in structure and which costs lesser manufacturing expense in the mass production and hence providing high yield.

Another objective of the present invention is to provide a buried inductive element structure of slim type which is suitable to be implemented in handheld electronic devices with sizes shrink, where electronic components in the electronic devices occupy lesser space so as to enhance and facilitate layout of circuit paths within the mobile devices for providing more function features.

A buried inductive element structure of the present invention includes a base having a chamber, two stands and two terminals, wherein the chamber having a holding space is formed on the base, each stand is arranged on a corner of the base, the two terminals are respectively mounted inside the two stands, a bending part is formed on a top of each of the two terminals and is exposed to the base and each stand, a hook part is formed on the bottom of each of the two terminals, a part of the hook part is arranged inside the base, another part of the hook part is exposed to the base and is defined as a connecting part; an electronic component disposed securely at the bottom of the chamber and connected electrically to said connecting parts of said two terminals; coil disposed in said holding space and is located above said electronic component, having two ends connected electrically and respectively to said bending part of said two terminals; an printed circuit board disposed exteriorly of said base, wherein said bending parts of said two terminals are connected to said printed circuit board through Surface-mount technology (SMT) wherein, said base and said two stands are made from insulated materials, and said two terminals are conductive.

One distinct feature of the present invention resides in that the coil and the electronic component can be disposed within the chamber of the base in an overlap manner or side-by-side manner and they can be coupled electrically with the terminals in series or parallel, thereby providing multiple fundamental circuit, such as in case the electronic component is a resistor, the buried inductive element structure integrates with the resistor to form a resistor-inductor circuit and in case the electronic component is a capacitor, the buried inductive element structure integrates with the capacitor to form a capacitor-inductor circuit for serving as a resonant circuit, a filtering circuit or phase shift circuit and other circuit paths.

Another distinct feature of the present invention resides in that since the chamber of the base can accommodate one or several components, by providing two stands at appropriate positions of the base, the buried inductive element structure thus formed occupies a thickness or height less than 2 mm, hence the element connecting structure has tremendously small thickness. In case, a winding coil is implemented, the inductance capacity thereof may exceed greater than 100 μH. The buried inductive element structure of the present invention is highly suitable for electronic devices of sizes shrink, since the same occupies only a little space in the electronic devices, which in turn, facilitates in circuit layout in the electronic devices.

Since the buried inductive element structure of the present invention is simple in structure, the mass production cost thereof is reduced, especially owing to pre-setting of terminals on the base, the coil and the electronic component can be easily disposed in the chamber during the actual assembly of the inductive element structure of the present invention. Hence, high yield is achieved during the mass production.

The base of the present invention has a flat bottom surface such that automatic machines like vacuum suction means or gripping apparatuses can be applied to moving the same so as to facilitate precise and quick soldering onto a printed circuit board, hence providing high mass production with fine quality precision position among the elements.

Therefore, the buried inductive element structure of the present invention is suitable to be implemented in a handheld mobile device of slim type since it occupies little space, which in turn, results in extra space for layout of circuits in the printed circuit board in a flexible manner, thereby providing high circuit density to provide fine performance or functions.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
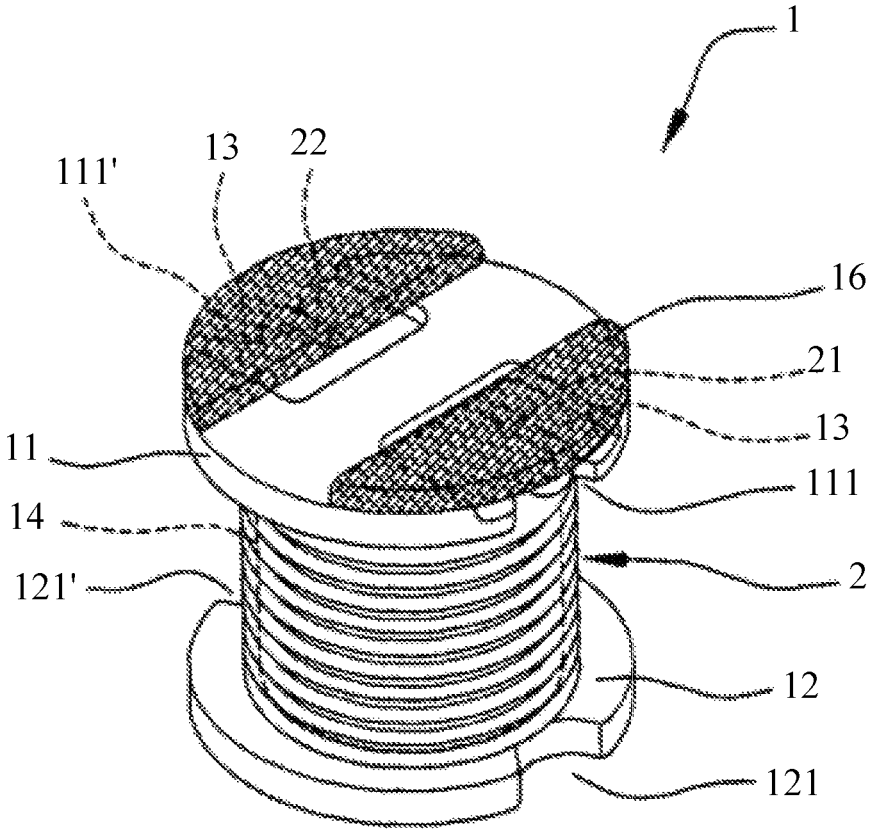
FIG. 1 (PRIOR ART)
FIG. 1 shows a perspective view of an inductive element of SMD (Surface Mount Device) type of prior art.
Figure 2:
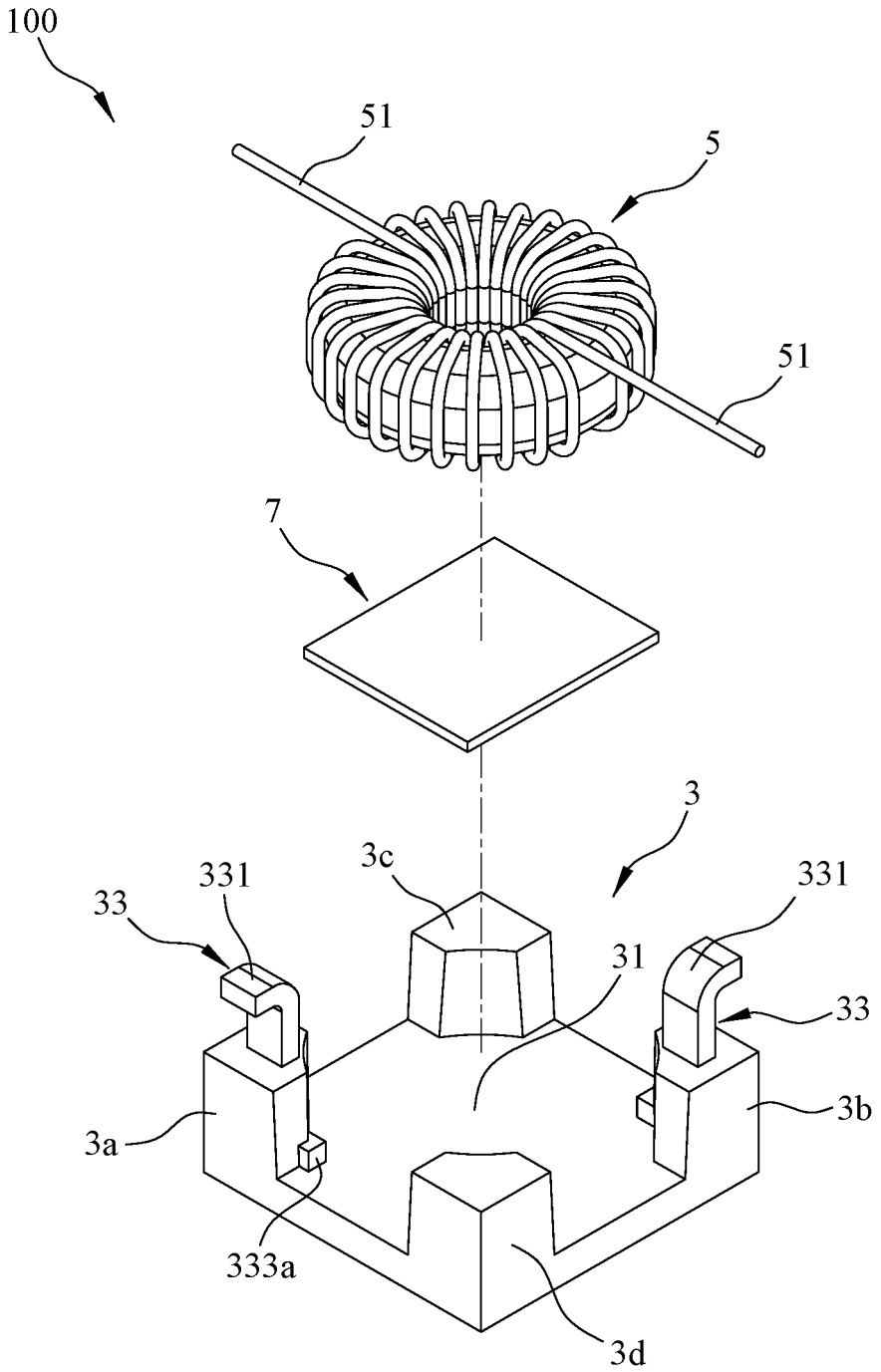
FIG. 2 shows an exploded and perspective view of the first preferred embodiment of a buried inductive element structure of slim type according to the present invention.
Figure 5:
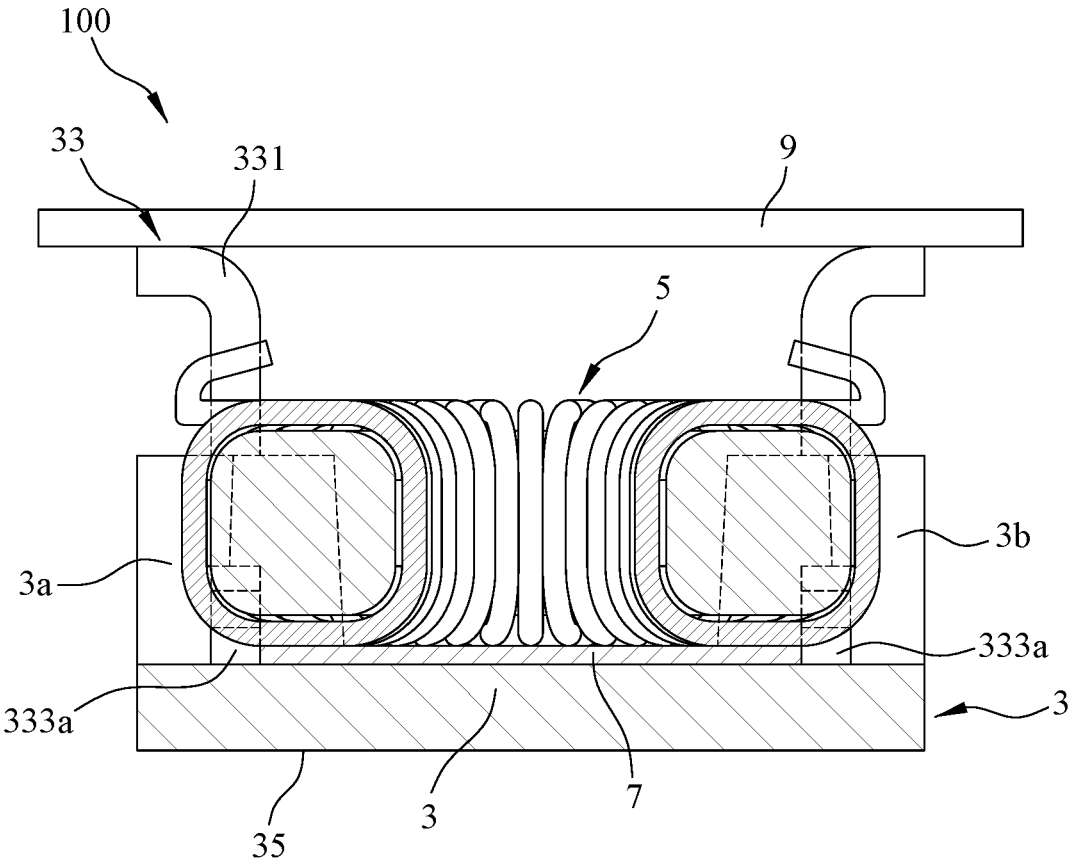
FIG. 5 shows a cross sectional view of the first preferred embodiment of the buried inductive element structure of slim type according to the present invention.

FIG. 2 shows an exploded and perspective view of the first preferred embodiment of a buried inductive element structure of slim type according to the present invention while FIG. 5 shows a cross sectional view of the first preferred embodiment of the buried inductive element structure of slim type according to the present invention. As illustrated, the inductive element structure 100 of the present invention includes a base 3, a coil 5, an electronic component 7 and an printed circuit board 9, wherein the base 3 having a chamber, two stands 3*a*, 3*b* and two terminals 33, wherein the chamber having a holding space 31 is formed on the base 3, each stand is arranged on a corner of the base 3. Preferably, both of two stands and two terminals 33 located at two opposite corners thereof. Preferably, the base 3 is made from insulated materials while the inner peripheral wall confining the holding space 31 is annular with or without disconnected parts. In this embodiment, the holding space 31 is defined by four annular wall parts, as best shown in FIG. 2.

Figure 3:
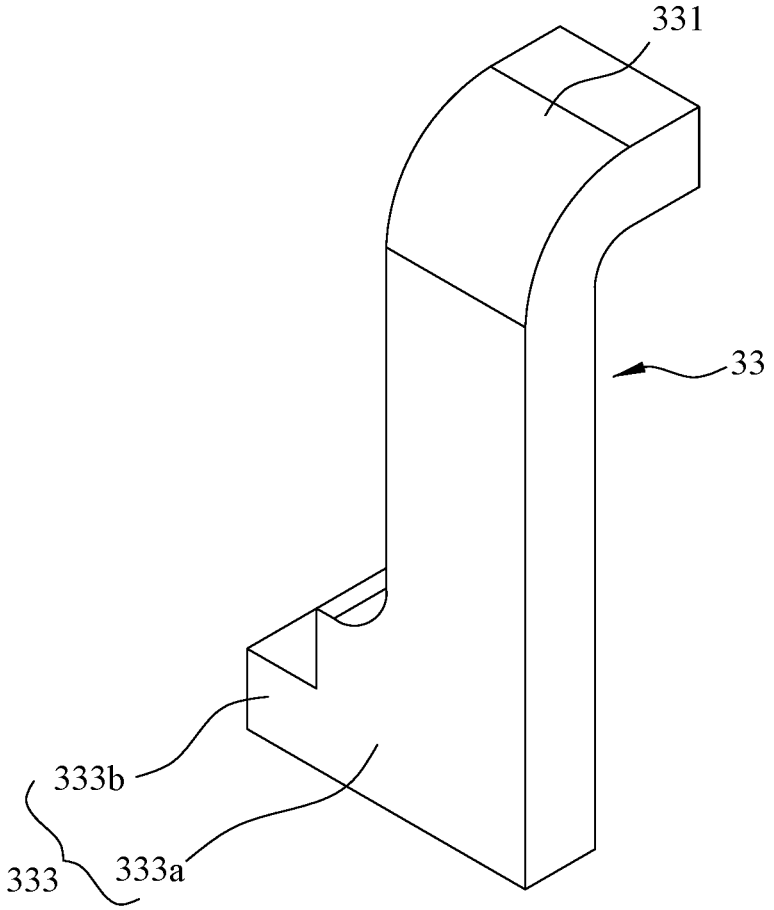
FIG. 3 shows a perspective view of a terminal employed in the buried inductive element structure of slim type according to the present invention.
Figure 4:
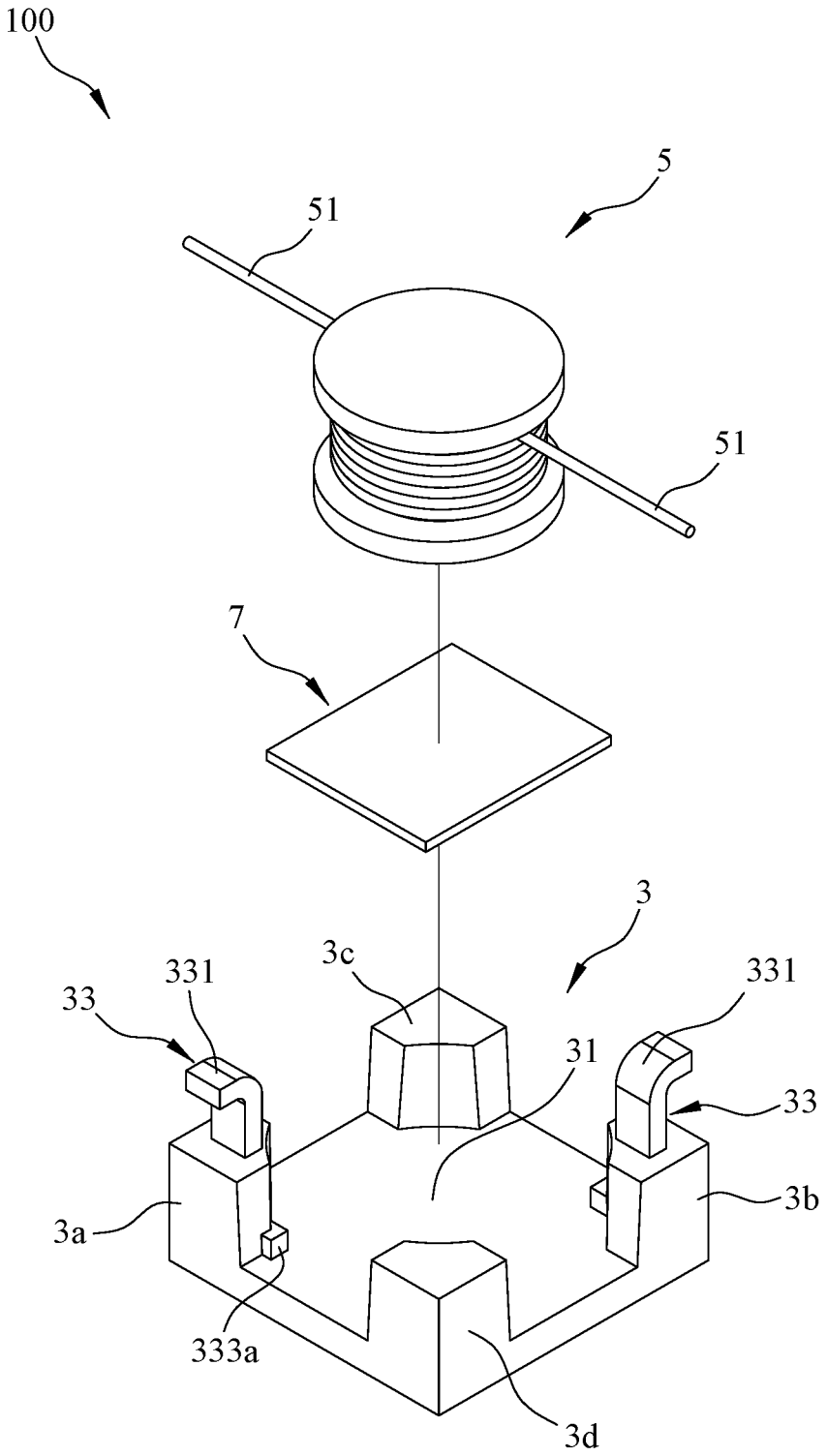
FIG. 4 shows an exploded view of the buried inductive element structure of slim type according to the present invention, illustrating a wire coil of generally I-shaped.

FIG. 3 shows a perspective view of a terminal employed in the buried inductive element structure of slim type according to the present invention. Also referring to FIG. 2, the two terminals 33 are respectively mounted inside the two stands 3*a*, 3*b*, a bending part 331 is formed on a top of each of the two terminals 33 and is exposed to the base 3 and each stand 3*a*, 3*b*, a hook part 333 is formed on the bottom of each of the two terminals 33, a part of the hook part 33 is arranged inside the base 3 and is defined as a buried parts 333*b*, another part 333*b* of the hook part 33 is exposed to the base 3 and is defined as a connecting part 333*b*. The two stands 3*a*, 3*b* are also made from insulated materials. The two terminals 33 are conductive.

Referring to FIGS. 2 and 5, The electronic component 7 is disposed securely at the bottom of the chamber and is located under the coil 5, The electronic component 7 is connected electrically to the connecting parts 333*a* of the two terminals 33. the coil 5 is disposed in the holding space 31 of the chamber, has two opposite ends 51 connected electrically and respectively to the bending part 331 of the two terminals 33. The bottom surface of the base 3 is a planar structure 35. Preferably, the electronic component 7 is selected from a group consisting of a capacitor, a resistor and an inductor or other appropriate electronic elements.

The printed circuit board 9 disposed exteriorly of said base 3, wherein the bending part 331 of two terminals are connected to the printed circuit board through Surface-mount technology (SMT).

In this embodiment, the coil 5 and the electronic component 7 are installed securely in the bottom 31 of the chamber via dispensing means (not shown) or other appropriate fixations. To be more specific, the dispensing means is conducted on bottom surface of the coil 5 or on top/bottom surface of the electronic component 7 inside the holding space 31 of the base 3 for securing the coil 5 and the electronic component 7 within the holding space 31.

In this preferred embodiment, the electronic component 7 is disposed below the coil 5 (see FIG. 5) or above the coil 5, front and rear side of the coil 5 depending on the requirement of the actual applications and their relative position relationship is not the feature of the present invention, such that the detailed description is omitted herein for the sake of brevity.

Preferably, the base 3 is rectangular, circular, triangular polygonal or other geometrical configurations. The above base 3 is shown in rectangular to facilitate explanation and better understanding of the present invention.

Referring again to FIG. 2, to be more specific, the stands 3*a*, 3*b* projects upward or vertically from the upper surface at two diagonal corners of the base 3.

In one preferred embodiment of the present invention, the buried inductive element structure 100 further includes an extra electronic component 8 (see FIG. 7B) while the base 3 further includes an extra pair of stands 3*c*, 3*d* upon which another two terminals 33 are mounted respectively and such that the extra electronic component 8 is connected electrically with connecting parts of the another two terminals 33 respectively.

The previously stated stands 3*a*, 3*b*, 3*c*, 3*d* projects upward or vertically from four corners of the base 3 such that the connecting parts 333*a* of the terminals 33 are exposed from the stands 3*a*, 3*b*, 3*c*, 3*d* respectively.

Each of the stands 3*a*, 3*b*, 3*c*, 3*d* is provided with one terminal 33 while the coil 5 has two pair of opposite ends 51 for connecting electrically to four terminals 33 to facilitate the soldering process and to reduce the thickness of the coil 5 and the electronic component after assembly such that the four hook parts 333 of the terminals 33 located densely and closely on the base 3.

Preferably, the chamber is defined by four stands 3*a*, 3*b*, 3*c*, 3*d*, thereby forming four gaps between an adjacent pair of the stands 3*a*, 3*b*, 3*c*, 3*d*, which in turn, reduce the material for formation of the chamber 31. The number of the stands 3*a*, 3*b*, 3*c*, 3*d* should not be restricted only to four, and should depend on the actual requirement of the desired product.

One distinct feature of the present invention resides in that owing to presence of the reception chamber 31 of the base 3, the coil 5 and the electronic component 7 can be disposed within the chamber in an overlap manner or side-by-side manner and they can be coupled electrically with the terminals 33 in series or parallel, thereby providing multiple fundamental circuit, such as in case the electronic component is a resistor, the buried inductive element structure 100 of the present invention integrates with the resistor to form a resistor-inductor circuit and in case the electronic component is a capacitor, the buried inductive element structure 100 of the present invention integrates with the capacitor to form a capacitor-inductor circuit for serving as a resonant circuit, a filtering circuit or phase shift circuit and other circuit paths.

Figure 6A:
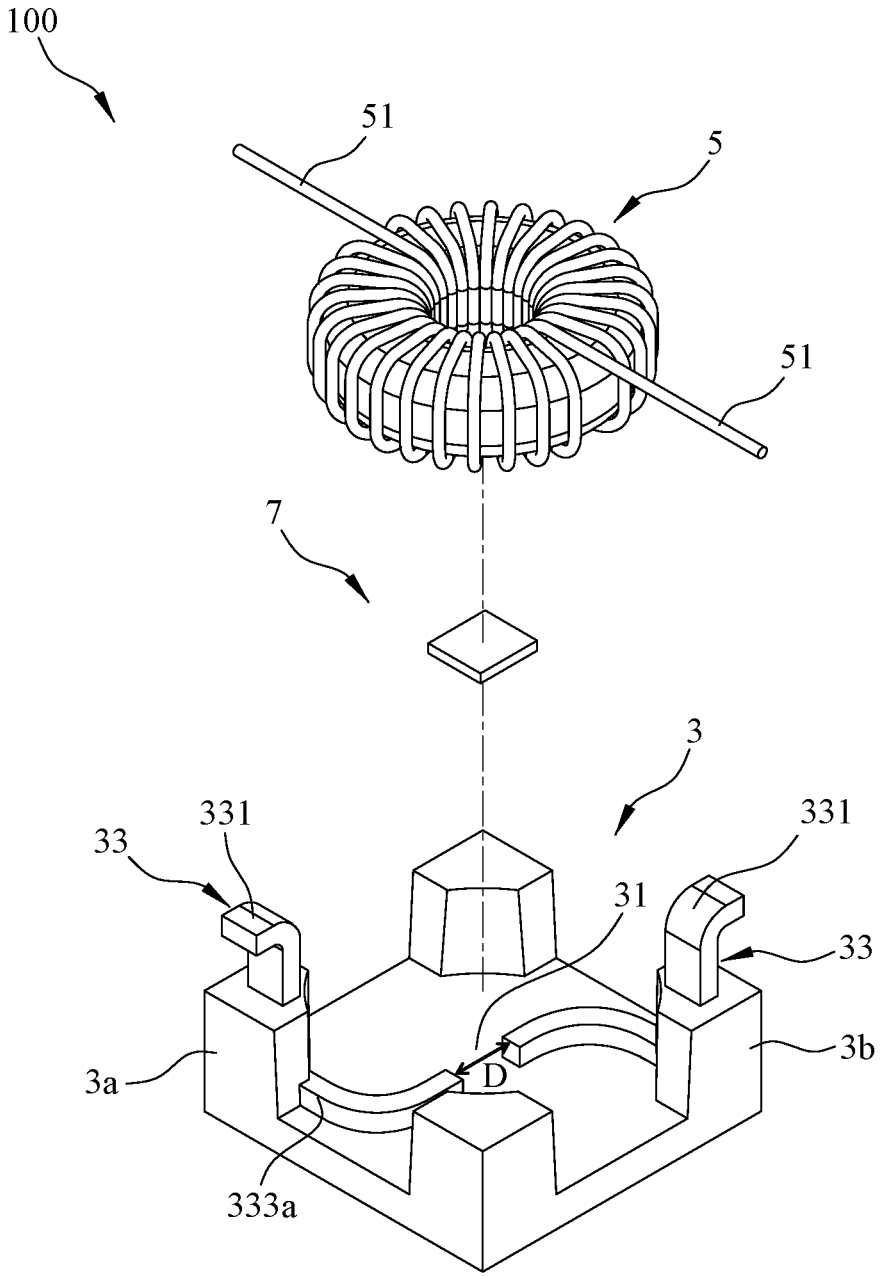
FIG. 6A shows an exploded and perspective view of the second preferred embodiment of the buried inductive element structure of slim type according to the present invention.
Figure 6B:
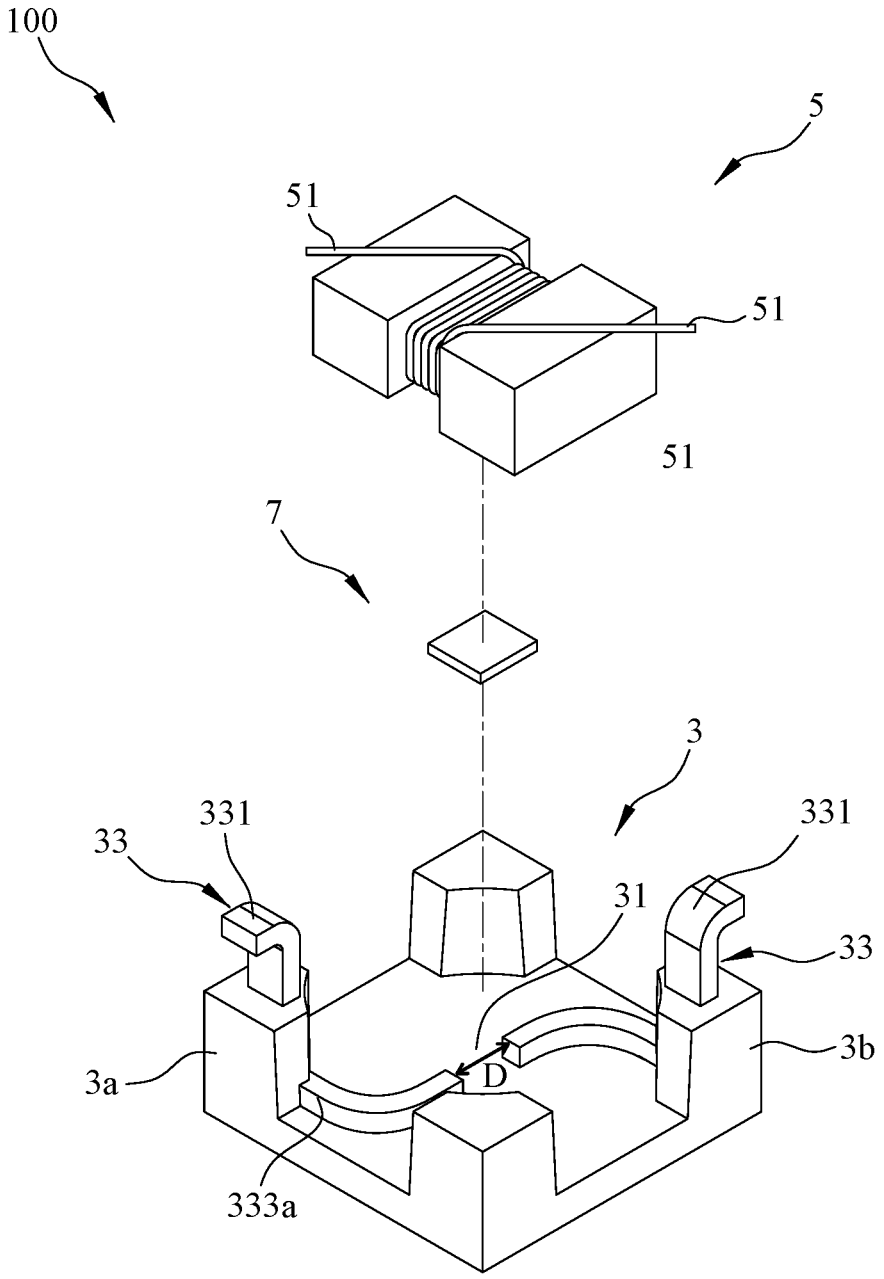
FIG. 6B shows an exploded and perspective view of the third preferred embodiment of the buried inductive element structure of slim type according to the present invention.
Figure 6C:
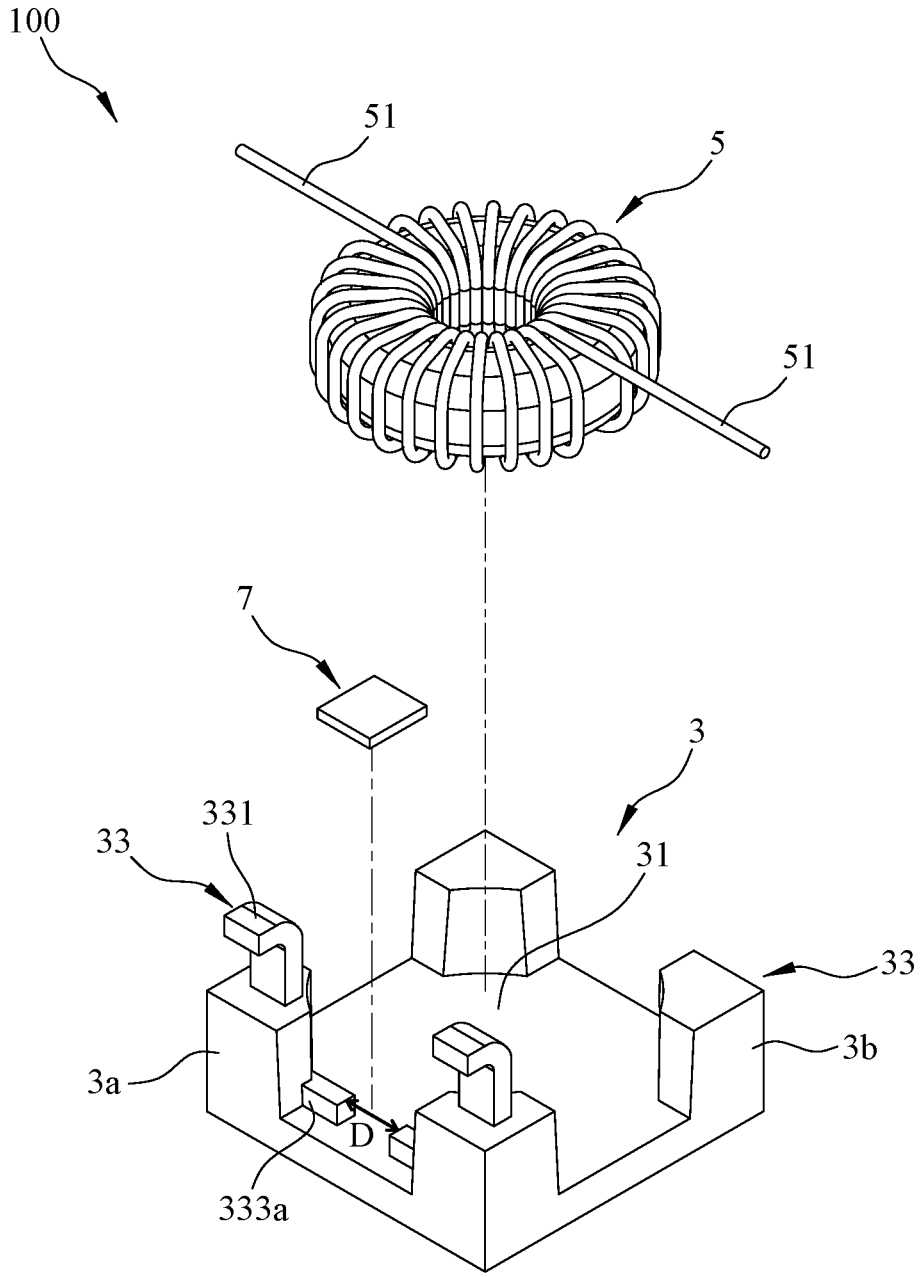
FIG. 6C shows an exploded and perspective view of the fourth preferred embodiment of the buried inductive element structure of slim type according to the present invention.
Figure 6D:
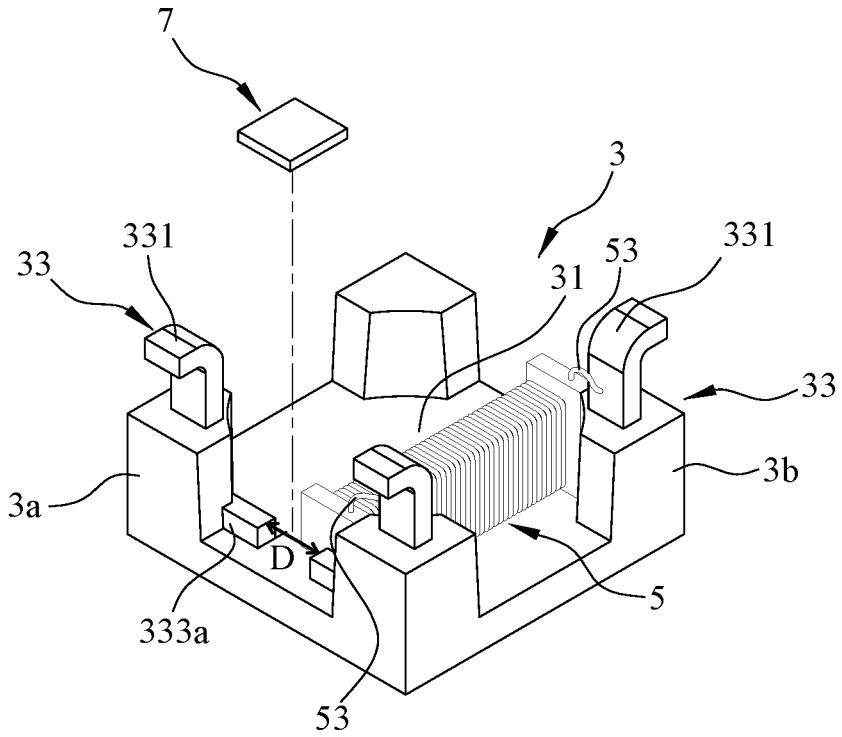
FIG. 6D shows an exploded and perspective view of the fifth preferred embodiment of the buried inductive element structure of slim type according to the present invention.

Referring to FIGS. 6A-6D, wherein FIG. 6A shows an exploded and perspective view of the second preferred embodiment of the buried inductive element structure of slim type according to the present invention; FIG. 6B shows an exploded and perspective view of the third preferred embodiment of the buried inductive element structure of slim type according to the present invention; FIG. 6C shows an exploded and perspective view of the fourth preferred embodiment of the buried inductive element structure of slim type according to the present invention; and FIG. 6D shows an exploded and perspective view of the fifth preferred embodiment of the buried inductive element structure of slim type according to the present invention. As illustrated in FIG. 6A, the inductive element structure 100 of the present invention includes at least a base 3 and a coil 5, their structures are similar to the first embodiment in general except that the connecting parts 333*a* of the terminals 33 are generally curved to possess free ends aligned with each other and define a gap D therebetween so that a magnetic field with storage capacity is generated at the gap.

Note that the above two terminals 33 are disposed on the base 3 at diagonal position relative to each other (see FIG. 6A). Preferably, a coil 5 having low inductance capacity with I-shaped core is implemented as shown in FIG. 6B or the two terminals 33 are mounted on adjacent pair of the stands aligned relative to each other so does the connecting parts 333*a* of the terminals 33 as best shown in FIG. 6C. FIG. 6D shows the coil 5 and the electronic component 7 are disposed side-by-side in the chamber 31 while the I-shaped core itself has two opposite ends respectively provided with connecting terminals 53 for establishing electrical connecting with the terminals 33. To be more specific, suitable soldering process is conducted to electrically connecting the connecting terminals 53 of the coil 5 to the terminals 33.

Figure 6E:
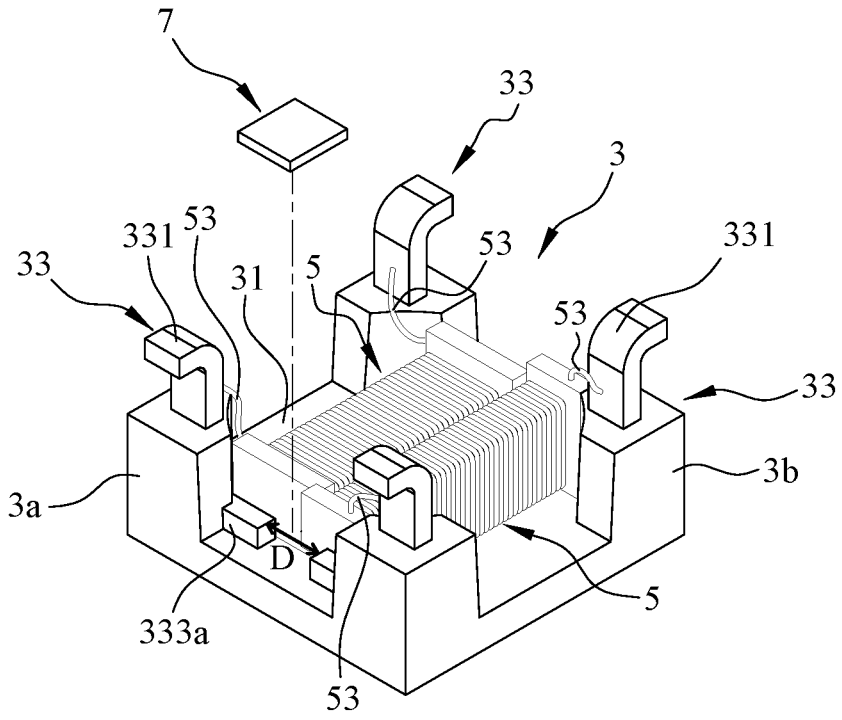
FIG. 6E shows an exploded and perspective view of the sixth preferred embodiment of the buried inductive element structure of slim type according to the present invention.

FIG. 6E shows an exploded and perspective view of the sixth preferred embodiment of the buried inductive element structure of slim type according to the present invention. The only difference relative to the previous embodiment resides in that two units of coils 5 with I-shaped cores are implemented one in erected posture while the other one in flat posture within the reception chamber 31.

In the second and third preferred embodiments of the present invention, the electronic component 7 is disposed in the chamber 31 at one side of the coil 5 and is connected electrically to two connecting parts 333*a* of the terminals 33, which are disposed diagonally relative to each other on the base 3.

When a current is applied to the terminals 33 in case of operation, a magnetic field is generated between two spaced apart connecting parts 333*a* at the gap D since the latter serves as insulated medium (the atmosphere), thereby providing the inductance effects and eliminating presence of an actual inductor. Of course, the electronic component 7 (like a capacitor) can be coupled electrically to the connecting parts 333*a* of the terminals 33 so as to provide other specific feature (such as different inductance capacity).

Therefore, the buried inductive element structure 100 of the present invention can provide small and large inductance capacity and is suitable be implemented in different handheld mobile devices.

Figure 7A:
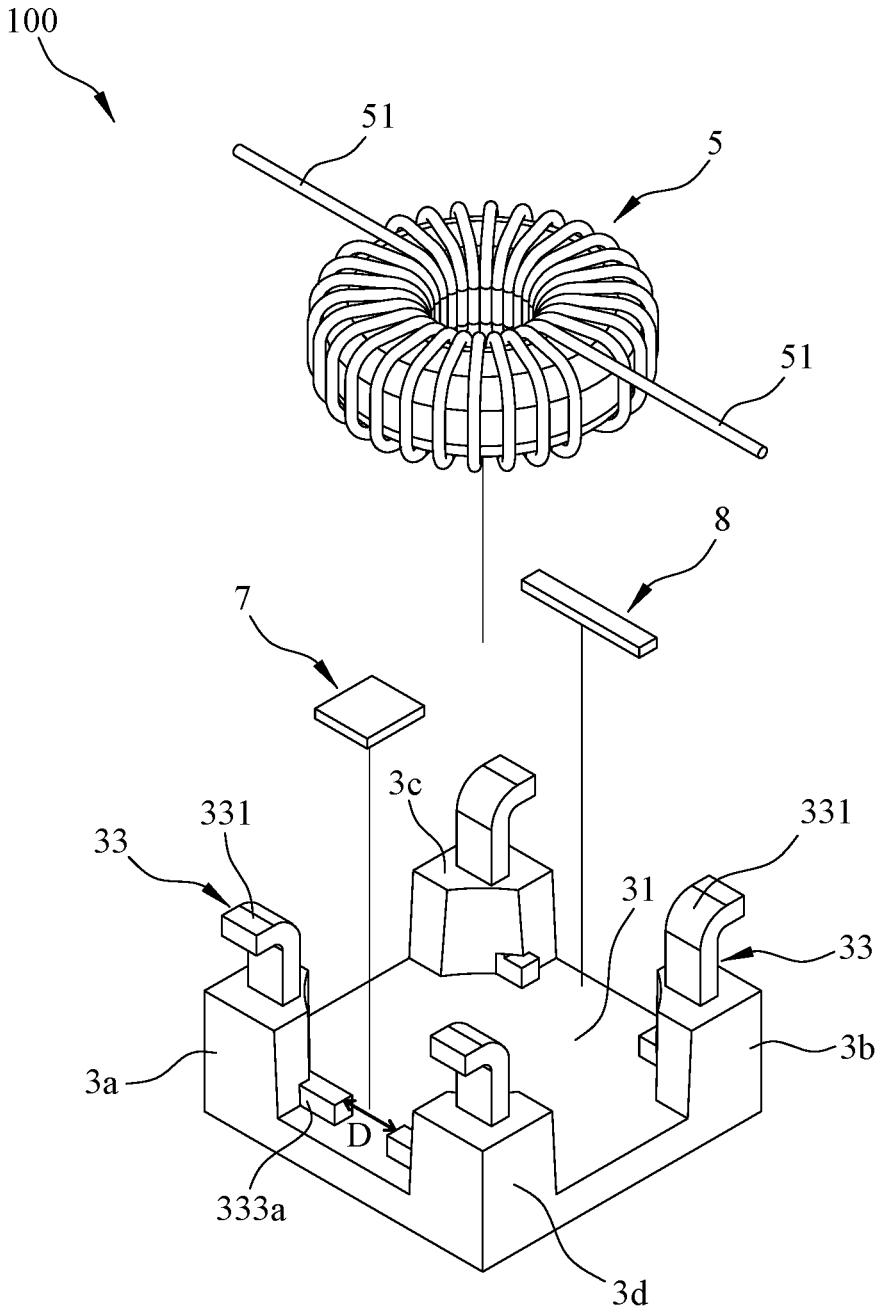
FIG. 7A shows an exploded and perspective view of the seventh preferred embodiment of the buried inductive element structure of slim type according to the present invention.

FIG. 7A shows an exploded and perspective view of the seventh preferred embodiment of the buried inductive element structure of slim type according to the present invention and has the structure similar to that of FIG. 6A, except that the seventh embodiment further includes an extra electronic component 8 while the base 3 further includes an extra pair of stands 3*c*, 3*d* upon which another two terminals 33 are mounted respectively and such that the extra electronic component 8 is connected electrically with the another two terminals 33 respectively. Preferably, the extra electronic component 8 is selected from a group consisting of a capacitor, a resistor and an inductor or other electronic elements.

One distinct feature of the present invention is that several circuits like RLC circuit (also known as resonant or tuned circuit), CLC (capacitor-inductor-capacitor) filtering circuit, and LCL (inductor-capacitor-inductor) filtering circuit can be constructed through the fourth embodiment with at least one wire coil.

Figure 7B:
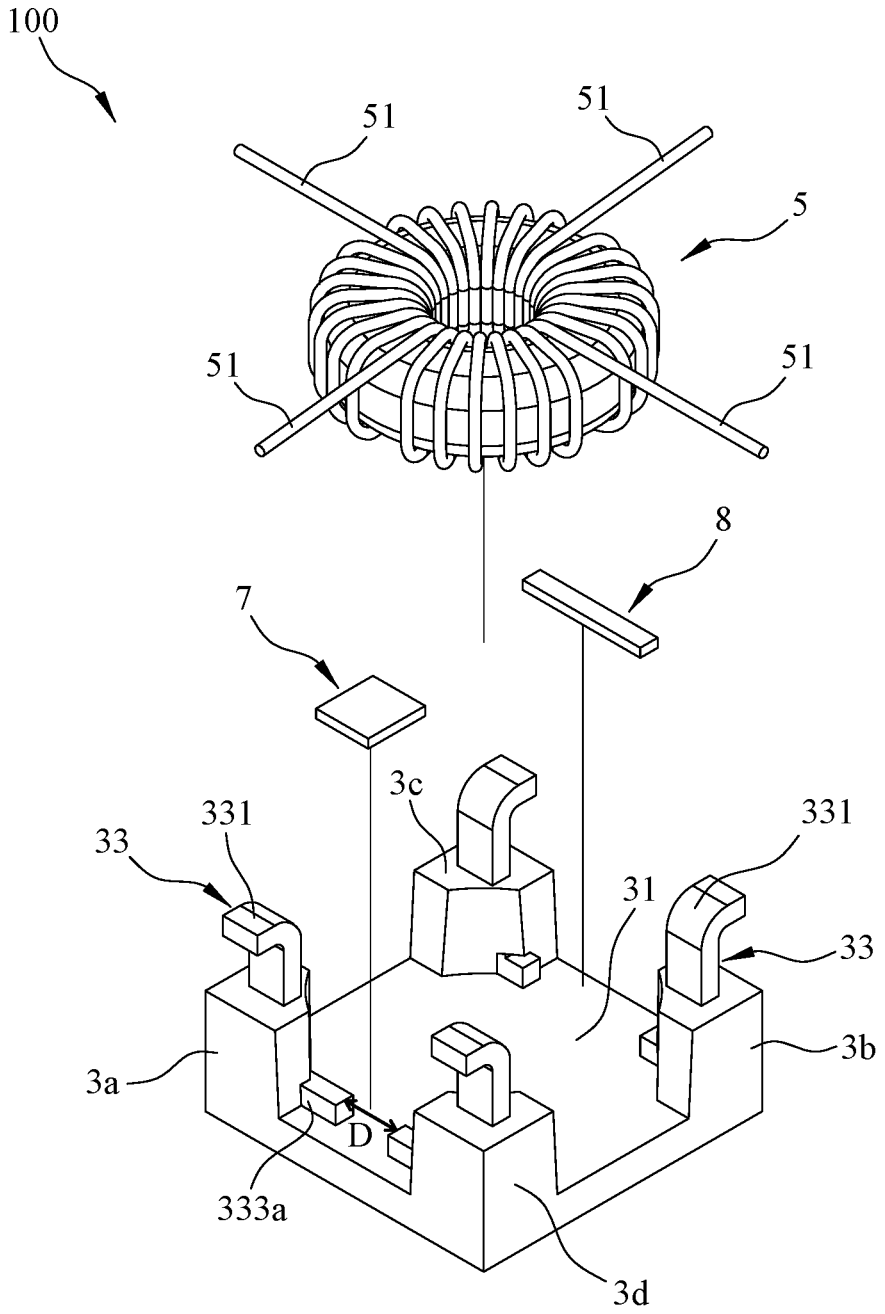
FIG. 7B shows an exploded and perspective view of the eighth preferred embodiment of the buried inductive element structure of slim type according to the present invention.

FIG. 7B shows an exploded and perspective view of the eighth preferred embodiment of the buried inductive element structure of slim type according to the present invention, in which two pairs of opposite ends of the coil 5 are connected electrically to the electronic components 7 and 8 respectively so as to form two independent parallel circuits, like RL (resistor-inductor circuit) and LC (inductor-capacitor circuit) circuits.

In these preferred embodiments, the coil 5 is simply an annular wire coil or preferably an I-shaped such that inner wall surface of the chamber 31 or the stands 3*a*, 3*b*, 3*c*, 3*d* should be curved to fittingly contact the periphery the coil 5 so as to enhance securing of the latter within the chamber. Note that the configurations of the coil 5, the electronic component 7 and the chamber 31 are used only to describe and explain the concept of the present invention so that these configurations should not restrict the claim scope of the buried inductive element structure of the present invention.

Figure 8:
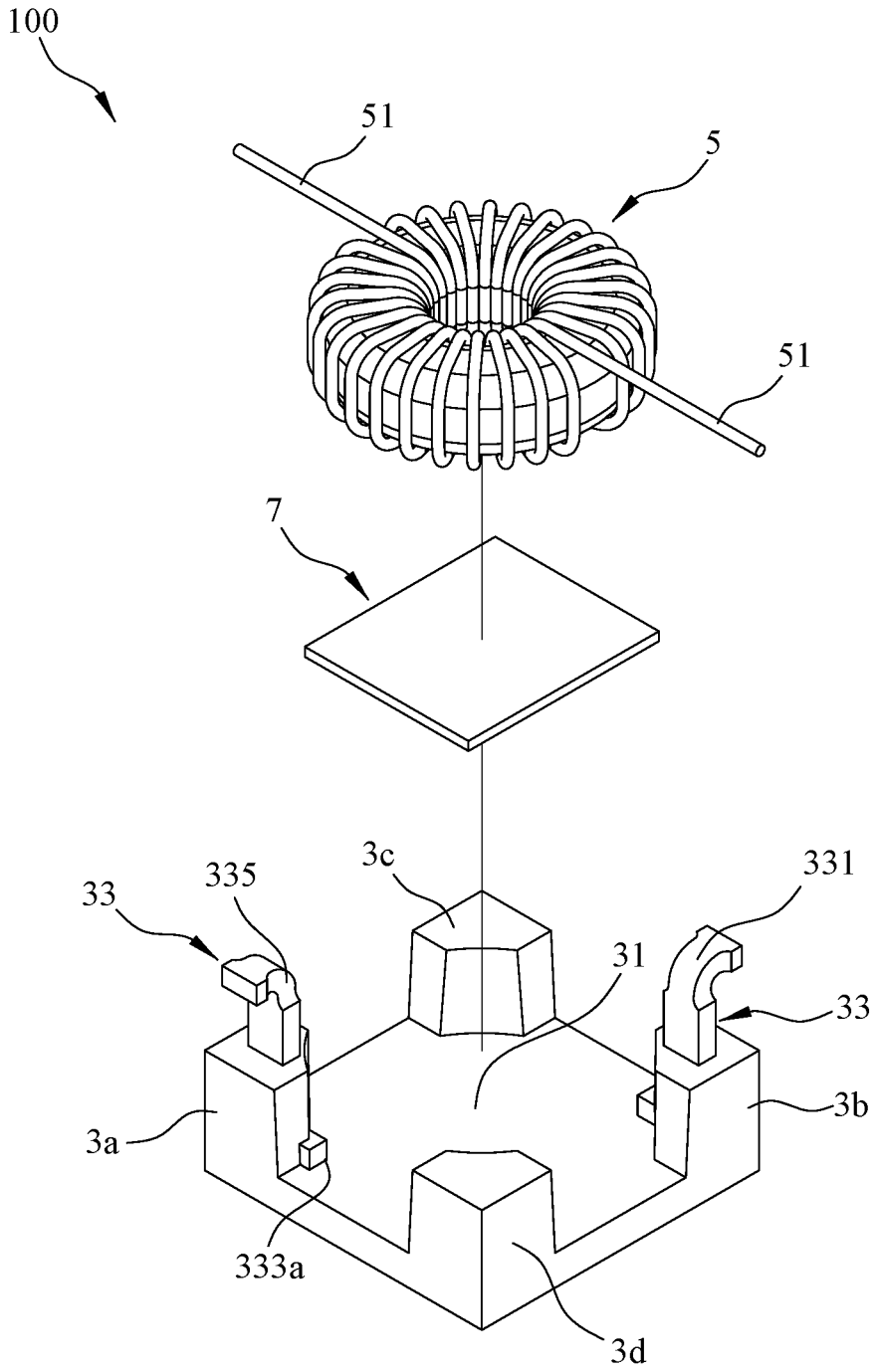
FIG. 8 shows an exploded and perspective view of the ninth preferred embodiment of the buried inductive element structure of slim type according to the present invention.

FIG. 8 shows an exploded and perspective view of the ninth preferred embodiment of the buried inductive element structure of slim type according to the present invention and has the structure similar to the first preferred embodiment except that the bending part 331 of each of the terminals 33 is formed with a constricted portion 335 to permit winding of a respective one of said opposite ends 51 of said coil 5 so as to prevent movement of the wire coil 5 during the winding process relative to the terminals 33.

The distinct features of the present invention further includes since the base 3 can define one or more than one chambers and since the terminals 33 can be erected at appropriate location, the buried inductive element structure thus produced has a thickness lower than 2 mm. Hence the handheld mobile device implementing the same is relatively shrunk in size owing to occupation of little space therein and the winding coil provides inductance capacity greater than 100 μH. In other words, the buried inductive element structure of the present invention facilitates finer layout of circuit paths in the electronic device using the same.

Owing to the bottom surface of the base is a planar structure, automatic machines like vacuum suction means or gripping apparatuses can be applied to moving the same so as to facilitate precise and quick soldering onto a printed circuit board, hence providing high mass production with fine quality precision position among the elements.

In addition, the I-shaped magnetic core 1 of the core 5 permits wrapping of winding turns thereon, and the increased number of winding turns within the chamber can induce higher inductance capacity, Another distinct feature of the present invention resides in that since the buried inductive element structure is simple in structure which costs lesser manufacturing expense in the mass production and hence providing high yield. Because, one pair of terminals 33 is mounted in advance, during the actual assembly, only the coil 5 and the electronic component 7 need to be assembled, thereby facilitating in mass production of the devices implementing the same.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A buried inductive element structure comprising:

a base having a chamber, two stands and two terminals, wherein the chamber having a holding space is formed on the base, each stand is arranged on a corner of the base, the two terminals are respectively mounted inside the two stands, a bending part is formed on a top of each of the two terminals and is exposed to the base and each stand, a hook part is formed on the bottom of each of the two terminals, a part of the hook part is arranged inside the base, another part of the hook part is exposed to the base and is defined as a connecting part, an electronic component disposed securely at the bottom of the chamber and connected electrically to said connecting parts of said two terminals;

a coil disposed in said holding space and is located above the said electronic component, having two ends connected electrically and respectively to said bending part of said two terminals; and a printed circuit board disposed exteriorly of said base, wherein said bending parts of said two terminals are connected to said printed circuit board through Surface-mount technology (SMT), wherein said base and said two stands are made from insulated materials, and said two terminals are conductive.

2. The buried inductive element structure according to claim 1, wherein said electronic component is disposed securely at the bottom of the chamber via dispensing means, and said coil is disposed securely above the said electronic component.

3. The buried inductive element structure according to claim 1, wherein said electronic component is selected from a group consisting of a capacitor, a resistor and an inductor.

4. The buried inductive element structure according to claim 1, wherein said two terminals are mounted respectively on said two stands at two diagonal corners of said base.

5. The buried inductive element structure according to claim 1, wherein said coil is a winding coil in a ring shape or in a I-shaped, said chamber has an annular inner wall defining said holding space, and each of said ends of said coil is electrically connected with said bending part of each of said two terminals.

6. The buried inductive element structure according to claim 1, wherein said bending part of each of said terminals is formed with a constricted portion to permit winding of a respective one of said opposite ends of said coil.

7. The buried inductive element structure according to claim 1, wherein the bottom surface of the base is a planar structure.

8. A buried inductive element structure comprising:

a base having a chamber, two stands and two terminals, wherein the chamber having a holding space is formed on the base, each stand is arranged on a corner of the base, the two terminals are respectively mounted inside the two stands, a bending part is formed on a top of each of the two terminals and is exposed to the base and each stand, a hook part is formed on the bottom of each of the two terminals, a part of the hook part is arranged inside the base, another part of the hook part is exposed to the base and is defined as a connecting part;

a coil disposed in said holding space of said chamber, having two opposite ends connected electrically and respectively to said bending part of said two terminals; and a printed circuit board disposed exteriorly of said base, wherein said bending parts of said two terminals are connected to said printed circuit board through Surface-mount technology (SMT), wherein said connecting parts of said two terminals define a gap therebetween, wherein said base and said two stands are made from insulated materials, and said two terminals are conductive.

9. The buried inductive element structure according to claim 8, further comprising: an electronic component, disposed securely at the bottom of the chamber and connected electrically to said connecting parts of said two terminals.

10. The buried inductive element structure according to claim 8, wherein the bottom surface of the base is a planar structure.

* * * * *